US008395550B2

(12) United States Patent
Ryoo et al.

(10) Patent No.: US 8,395,550 B2
(45) Date of Patent: Mar. 12, 2013

(54) MICRO STRIP ANTENNA

(75) Inventors: Jeong Ki Ryoo, Anyang (KR); Jae Yul Choo, Yongin (KR); Chu Yong Lee, Seoul (KR); Hosung Choo, Seoul (KR); Ikmo Park, Yongin (KR)

(73) Assignee: LS Industrial Systems Co., Ltd., Anyang-Si, Gyeonggi-Do (KR)

( * ) Notice: Subject to any disclaimer, the term of this patent is extended or adjusted under 35 U.S.C. 154(b) by 483 days.

(21) Appl. No.: 12/714,393

(22) Filed: Feb. 26, 2010

(65) Prior Publication Data

US 2011/0193747 A1 Aug. 11, 2011

(30) Foreign Application Priority Data

Feb. 9, 2010 (KR) ..... 10-2010-0012070

(51) Int. Cl.
*H01Q 1/38* (2006.01)
*H01Q 9/38* (2006.01)
*H01Q 19/00* (2006.01)

(52) U.S. Cl. ..... 343/700 MS; 343/833; 343/810; 343/853; 343/829; 343/846

(58) Field of Classification Search ..... None
See application file for complete search history.

(56) References Cited

U.S. PATENT DOCUMENTS

| | | | | |
|---|---|---|---|---|
| 4,697,189 | A * | 9/1987 | Ness | 343/700 MS |
| 6,400,322 | B2 * | 6/2002 | Fang et al. | 343/700 MS |
| 6,819,290 | B2 * | 11/2004 | Hani et al. | 343/700 MS |
| 7,099,686 | B2 * | 8/2006 | Ro et al. | 455/550.1 |
| 7,173,564 | B2 * | 2/2007 | Park et al. | 343/700 MS |
| 7,403,159 | B2 * | 7/2008 | Gooshchin | 343/700 MS |
| 2005/0116867 | A1 * | 6/2005 | Park et al. | 343/725 |
| 2006/0001574 | A1 * | 1/2006 | Petros | 343/702 |

* cited by examiner

*Primary Examiner* — Trinh Dinh
(74) *Attorney, Agent, or Firm* — Lee, Hong, Degerman, Kang & Waimey

(57) ABSTRACT

The invention provides a micro strip antenna used for both a near-field region and a remote-field region. A micro strip antenna comprises: a first dielectric substrate; a main patch, having a triangle shape under the first dielectric substrate, configured to feed a radiation current; a second dielectric substrate over the first dielectric substrate; and a sub patch, formed under the second dielectric substrate, configured to desert a current from the main patch to provide a vertical magnetic field.

6 Claims, 13 Drawing Sheets

MICRO STRIP ANTENNA

CROSS-REFERENCE(S) TO RELATED APPLICATION

Pursuant to 35 U.S.C. §119(a), this application claims the benefit of earlier filing date and right of priority to Korean Patent Application No. 10-2010-0012070 filed Feb. 9, 2010, the entire contents of which is incorporated by reference herein in its entirety.

FIELD OF THE INVENTION

The present invention relates to a micro strip antenna including characteristics of circular polarization for use in near-field and remote-field regions.

BACKGROUND

A passive radio frequency identification system (RFID) may generally operate based on theories of mutual coupling and back scattering.

The theory of mutual coupling among antennas has application to a RFID system operating in a high frequency (HF) range such as an access authentication system or an access card system in transportations and securities. According to the theory of mutual coupling, information can be communicated between a tag and a reader antenna based on a proximity effect of electromagnetism so that the communication between them may not seriously influenced from dielectric materials around them. However, an interrogation range from the reader antenna to the tag is very short, and recognition of the reader antenna is performed not faster than another RFID system operating in an ultra high frequency (UHF) range.

The RFID system operating in an UHF range is depending on radiation and scattering characteristics of electromagnetic waves according to the theory of back scattering. The RFID system operating based on the theory of mutual coupling among antennas has a longer interrogation range and a faster recognition than that based on the theory of mutual coupling. Also, the RFID system according to the theory of back scattering can dramatically reduce a size of antenna.

However, since the RFID system according to the theory of back scattering has a lower recognition rate than that based on the theory of mutual coupling, there is a limit to wherever the RFID system according to the theory of back scattering can be widely used.

Recently, to increase a recognition rate of the RFID system, most researchers make the best of both the RFID systems operating based on theories of mutual coupling and back scattering in order to develop a reader antenna used in a UHF range at a near-field region.

To generate a magnetic field at an aperture of a conventional near-field antenna in a UHF range, coupled lines has a shorter length than that corresponding to a half-wavelength are arranged in a loop pattern, or a current flows at two patches in the opposite direction so that a strong magnetic field can be made between them in a vertical direction.

Accordingly, a near-field tag is easily recognized because of a strong magnetic field in a vertical direction, but a tag may not be recognized in a remote-field region.

SUMMARY OF THE INVENTION

An embodiment of the present invention is to provide a micro strip antenna comprising a main patch in a shape of triangle and a sub patch to provide a strong and uniform magnetic field in a vertical direction at a near-field region as well as to provide uniform gain and characteristics of circular polarization at a remote-field region.

An embodiment of the present invention is to provide a micro strip antenna which provide a strong and uniform magnetic field in a vertical direction at a location where is a predetermined distance from an aperture of the micro strip antenna.

An embodiment of the present invention is to provide a micro strip antenna having characteristics of circular polarization in front.

An embodiment of the present invention is to provide a micro strip antenna having a strong radiation gain in front.

An embodiment of the present invention is to provide a micro strip antenna comprising a main patch having a shape of triangle and a sub patch, which can be formed on a substrate having a dielectric constant, to reduce a cost of production and be produced under a mass production.

An embodiment of the present invention is to provide a micro strip antenna comprising a triangle-shape main patch configured to satisfy characteristics of circular polarization at a remote-field region and provide a strong radiation gain, and a plurality of sub patches configured to provide a uniform magnetic field at a near-field region, wherein the triangle-shape main patch and the plurality of sub patches are formed on a dielectric substrate for a mass production.

Also, the plurality of sub patches is configured to supplement a weak magnetic field in a vertical direction at center of the triangle-shape main patch, which is occurred by deserted current flowing in the opposite direction to main current flowing in the main patch.

An embodiment of the present invention is to provide a micro strip antenna having a simple structure for generating characteristics of circular polarization in a certain frequency bandwidth and a strong and uniform magnetic field in a vertical direction at a location where is a predetermined distance from an aperture of the antenna so that the micro strip antenna can be used in both near-field and remote-field regions.

In a preferred embodiment of the present invention, a micro strip antenna comprises: a first dielectric substrate; a main patch, having a triangle shape under the first dielectric substrate, configured to feed a radiation current; a second dielectric substrate over the first dielectric substrate; and a sub patch, formed under the second dielectric substrate, configured to desert a current from the main patch to provide a vertical magnetic field.

The micro strip antenna further comprises a ground plane provided under the first dielectric substrate, a coupling block provided under the ground plane and configured to feed a communication signal, and a feeding wire configured to electronically couple the coupling block to a feeding unit of the main patch.

In an embodiment of the present invention, the sub patch comprises a plurality of sub patch units, each arranged in parallel.

In an embodiment of the present invention, the sub patch unit has a shape of polygons and arcs.

In an embodiment of the present invention, a plurality of ground patterns are provided at predetermined portions of the first dielectric substrate, wherein the predetermined portions are corresponding to areas of the second dielectric substrate among the sub patch units.

In an embodiment of the present invention, the ground pattern has a shape of polygons and arcs.

In an embodiment of the present invention, the main patch comprises a slot provided in an inner side.

In an embodiment of the present invention, the main patch comprises three rounded corners.

In an embodiment of the present invention, the main patch and the sub patch are formed in a shape of micro strip under the first and second dielectric substrates.

BRIEF DESCRIPTION OF THE DRAWINGS

The above and other features of the present invention will become apparent from the following description of embodiments taken in conjunction with the accompanying drawings.

DETAILED DESCRIPTION OF THE INVENTION

The invention shows a micro strip antenna used for both a near-field region and a remote-field region. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

Hereinafter reference will now be made in detail to various embodiments of the present invention, examples of which are illustrated in the accompanying drawings and described below.

Figure 1A:
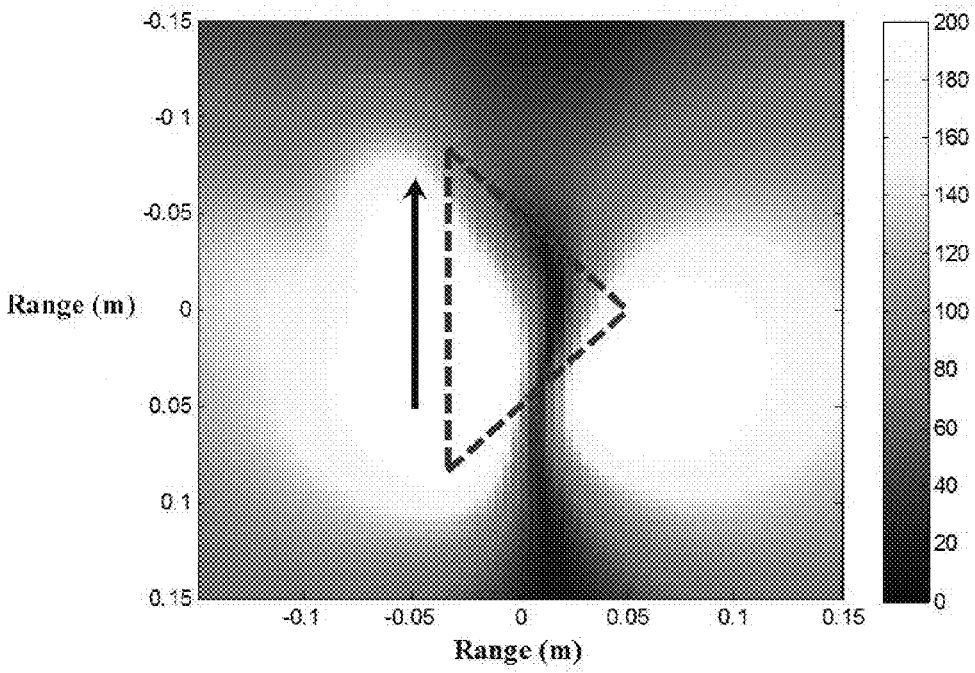
FIG. 1*a* is an electro-magnetic (EM) simulation result showing distribution of a vertical magnetic field when a triangle-shape patch is only included in an antenna.
Figure 1B:
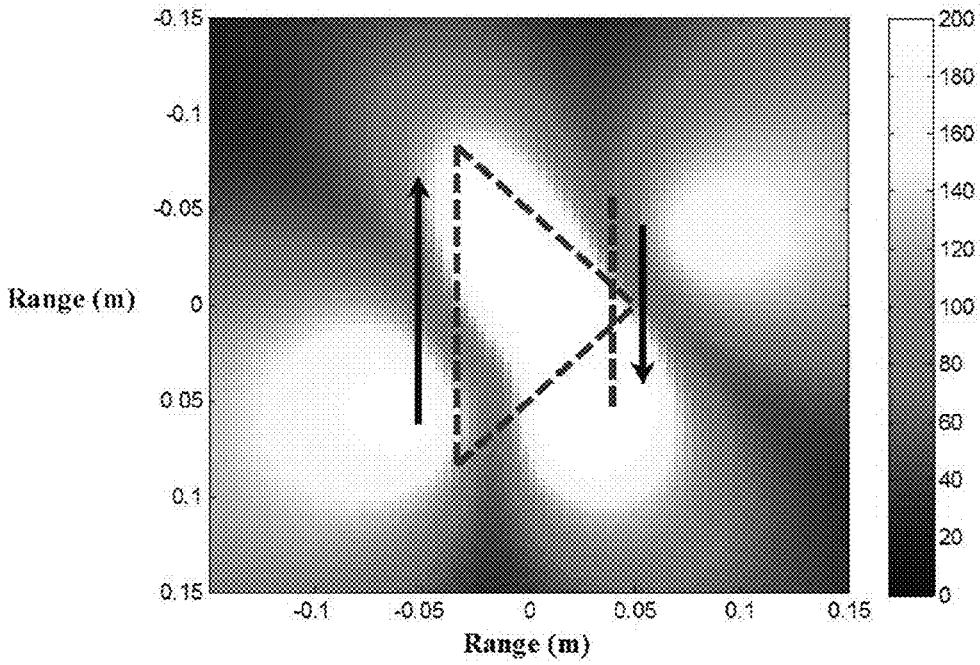
FIG. 1*b* is an EM simulation result showing distribution of a vertical magnetic field when a triangle-shape patch and a contra flow line are included in an antenna.

FIG. 1*a* is an electro-magnetic (EM) simulation result showing distribution of a vertical magnetic field when a triangle-shape patch is only included in an antenna, and FIG. 1*b* is an EM simulation result showing distribution of a vertical magnetic field when a current contra-flow line is inserted an antenna including a triangle-shape patch.

Referring to FIG. 1*a*, based on simulation results of near magnetic field according to different-shaped patch antennas, a null region of vertical magnetic field where a vertical magnetic field is not generated can be formed less in a triangle-shaped antenna than in rectangular-shaped or circular-shaped antennas.

Even though a triangle-shaped antenna can reduce a null region of vertical magnetic field, strength of vertical magnetic field is a weak at a certain region so that the triangle-shaped antenna may not stably recognize a tag used for a near-field region.

In an embodiment of the present invention, as shown in FIG. 1*b*, a line where a current is flowed in the opposite direction is inserted into the triangle-shaped antenna. If a current contra-flow line is provided to the antenna, a strong vertical magnetic field is created between the triangle-shaped antenna and the current contra-flow line. As a result, a reader antenna for a near-field region obtains a preferred magnetic field for interrogation or communication.

Figure 2A:
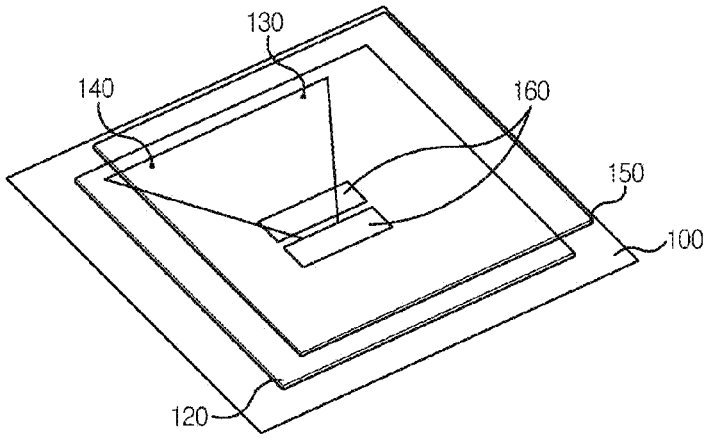
FIG. 2*a* is an oblique view showing a micro strip antenna according to an embodiment of the present invention.
Figure 2B:
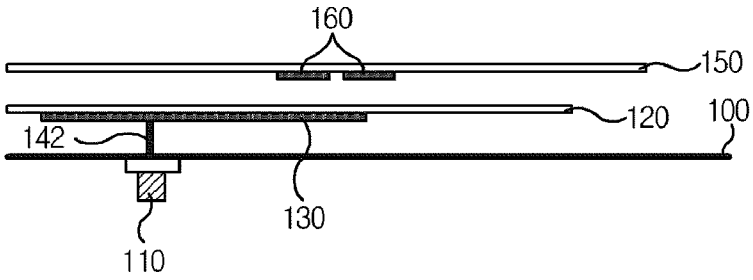
FIG. 2*b* is a cross-sectional view showing a micro strip antenna according to an embodiment of the present invention.

FIGS. 2*a* and 2*b* are an oblique view and a cross-sectional view showing a micro strip antenna according to an embodiment of the present invention.

The reference number 100 is a ground plane. The ground plane 100 comprises a coaxial cable coupling block 110 configured to feed a communication signal.

Over the ground plane 100, a first dielectric substrate 120 is provided. For example, a 'FR-4' substrate having a thickness of 1.6 mm and a dielectric constant of 4.2 can be used as the first dielectric substrate 120.

Under the first dielectric substrate 120, a triangle-shaped main patch 130 is printed in a shape of scrip line. Herein, the triangle-shaped main patch 130 can be formed in shapes of an equilateral triangle, an isosceles triangle, or a triangle including three sides which has different lengths.

At a corner of the triangle-shaped main patch 130, a feeding unit 140 is provided. The feeding unit 140 is coupled to the coaxial cable coupling block 110 via a feeding wire 142.

Over the first dielectric substrate 120, a second dielectric substrate 150 is provided. For example, like the first dielectric substrate 120, a 'FR-4' substrate having a thickness of 1.6 mm and a dielectric constant of 4.2 can be used as the second dielectric substrate 150.

Under the second dielectric substrate 150, a plurality of sub patches 160 are printed in a shape of scrip line to form a rectangular pattern.

Since the triangle-shaped main patch 130 described above has characteristics of circular polarization in a certain frequency bandwidth, the micro strip antenna according to an embodiment of the invention can generate a strong radiation gain.

Further, even though the plurality of sub patches 160 forms a rectangular pattern, the plurality of sub patches 160 generates a strong and uniform vertical magnetic field at a certain level from a surface of the micro strip antenna.

Figure 3A:
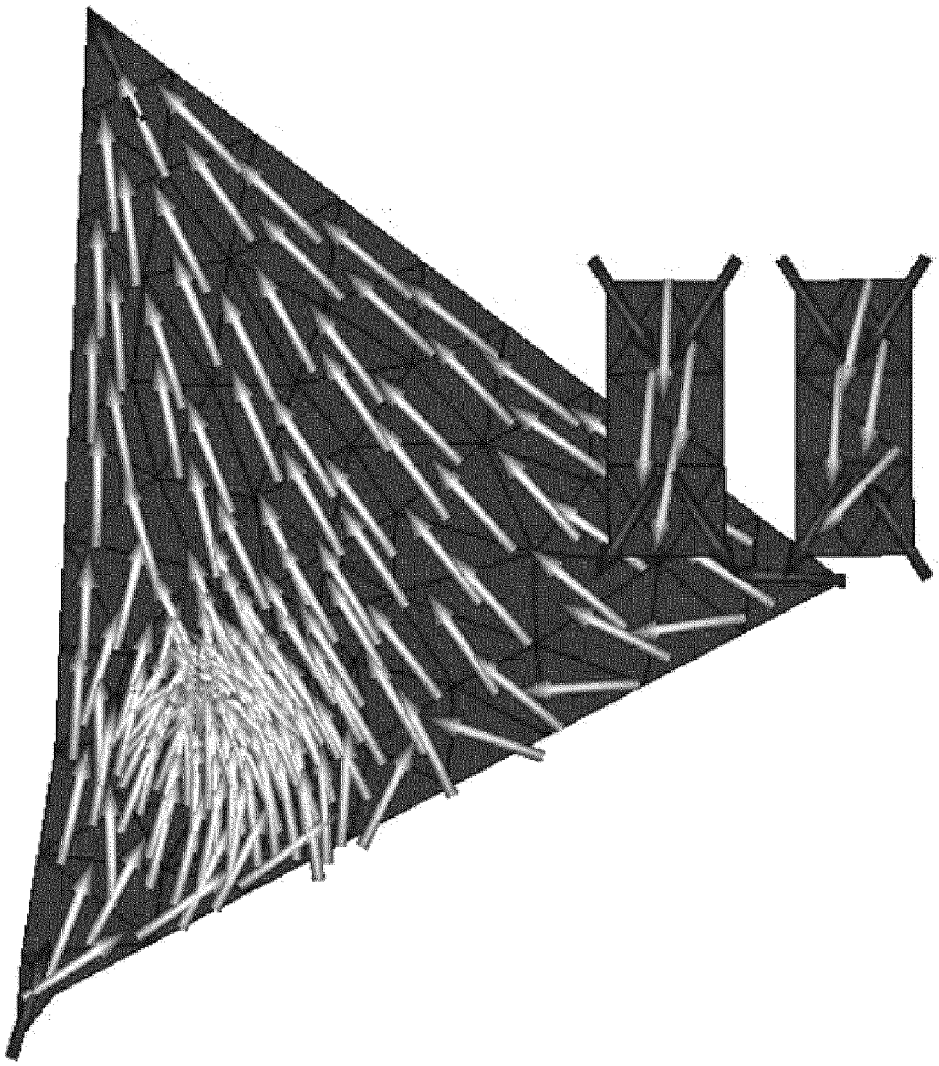
FIGS. 3*a* and 3*b* describe characteristics of current flowing a triangle-shape patch and a sub patch in a micro strip antenna according to an embodiment of the present invention in cases of $\omega t=0°$ and $\omega t=180°$.
Figure 3B:
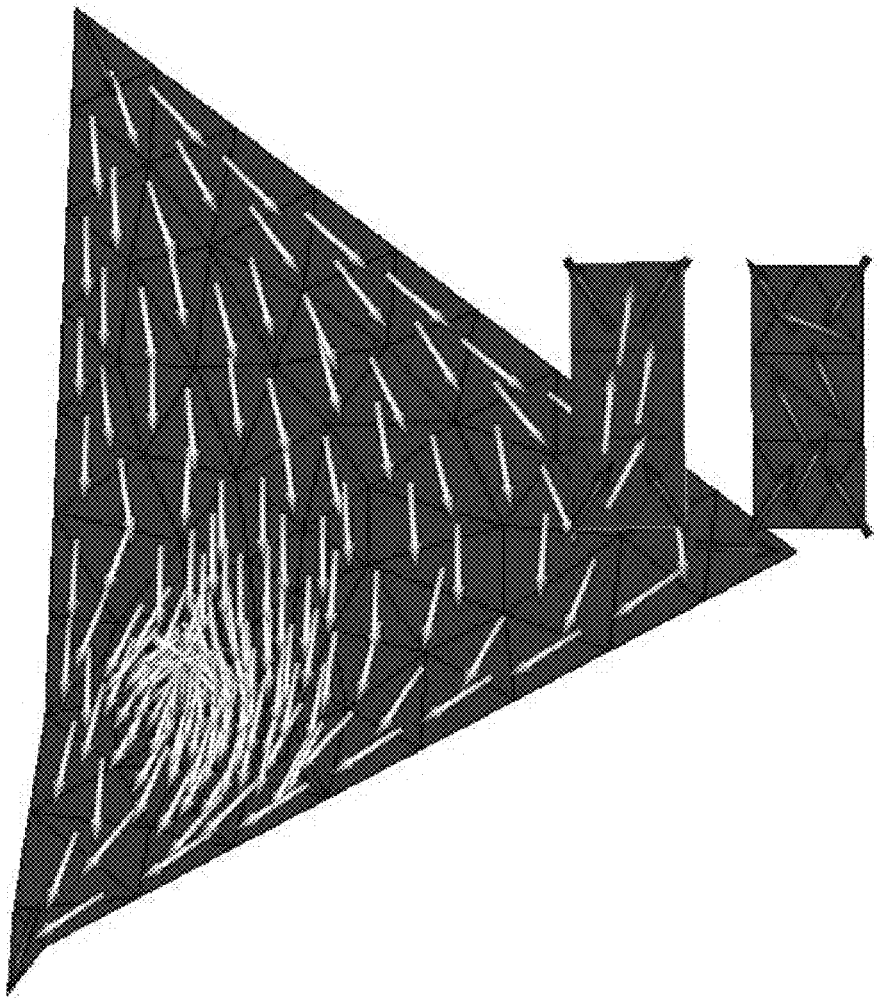

FIGS. 3*a* and 3*b* describe characteristics of current flowing a triangle-shape patch and a sub patch in a micro strip antenna according to an embodiment of the present invention in cases of $\omega t=0°$ and $\omega t=180°$. Herein, '$\omega$' is '$2\pi f$' and 't' is a time, where 'f' is a frequency.

In the case of $\omega t=0°$, in an overlapping area between the triangle-shaped main patch 130 and the sub patch 160 as shown in FIG. 3*a*, a current along the triangle-shaped main patch 130 is flowed to a top corner but a current along the sub patch 160 is flowed in the opposite direction, i.e., to a down side.

In the case of ωt=180°, in an overlapping area between the triangle-shaped main patch 130 and the sub patch 160 as shown in FIG. 3*a*, a current along the triangle-shaped main patch 130 is flowed to a down corner but a current along the sub patch 160 is flowed in the opposite direction, i.e., to a top side.

Thus, along the triangle-shaped main patch 130 and the sub patch 160, currents are flowed in the opposite direction so that a strong vertical magnetic field is generated between the triangle-shaped main patch 130 and the sub patch 160. Accordingly, a shaded section in a diagonal direction decreases.

Figure 4:
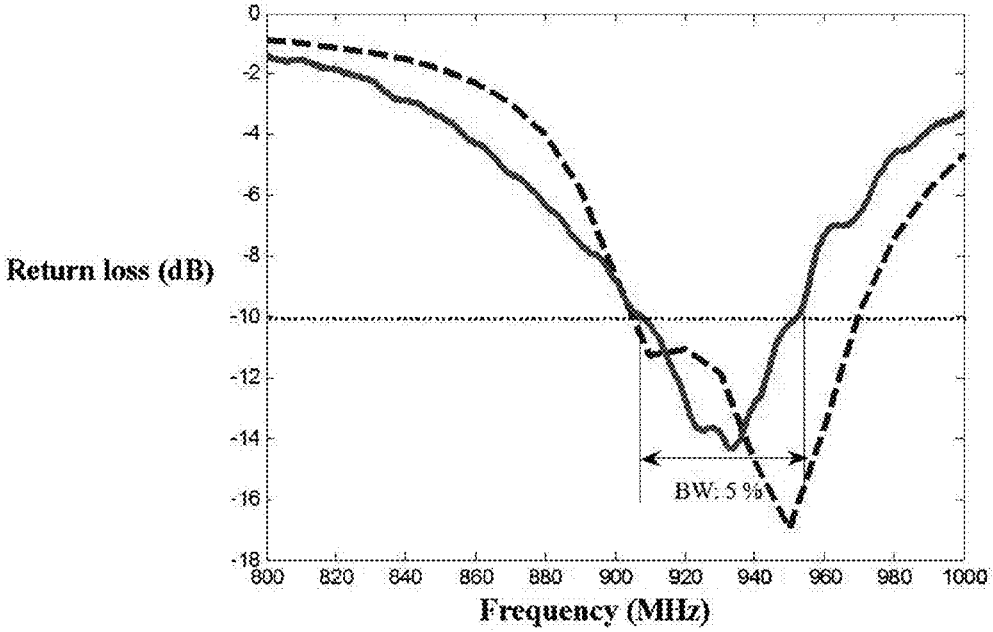
FIG. 4 is a graph depicting a return loss of the micro strip antenna.

FIG. 4 is a graph depicting a return loss of the micro strip antenna. Herein, a broken line is a simulation value and an unbroken line is a measurement. Referring to FIG. 4, the micro strip antenna according to an embodiment of the present invention has a frequency bandwidth (5%) of 900 to 950 MHz on a −10 dB basis.

Figure 5:
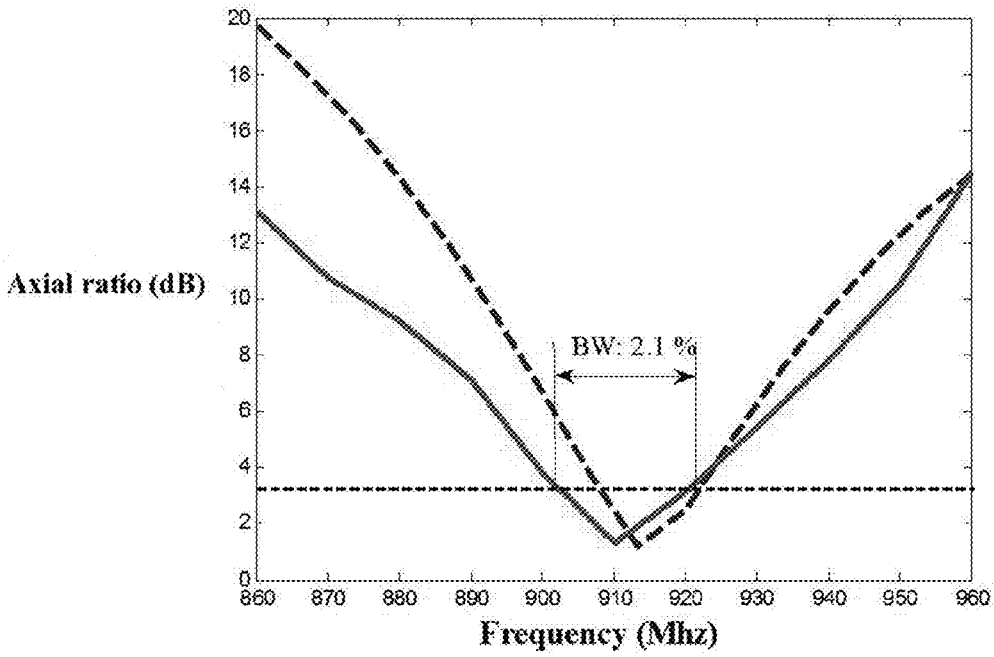
FIG. 5 is a graph depicting characteristics of circular polarization of the micro strip antenna.

FIG. 5 is a graph depicting characteristics of axial ratio (measurement for circular polarization) of the micro strip antenna. Herein, a broken line is a simulation value and an unbroken line is a measurement. Referring to FIG. 5, for generating circular polarization, the micro strip antenna according to an embodiment of the present invention has an axial ratio bandwidth (2.1%) of 902 to 920 MHz on a 3 dB basis.

Figure 6A:
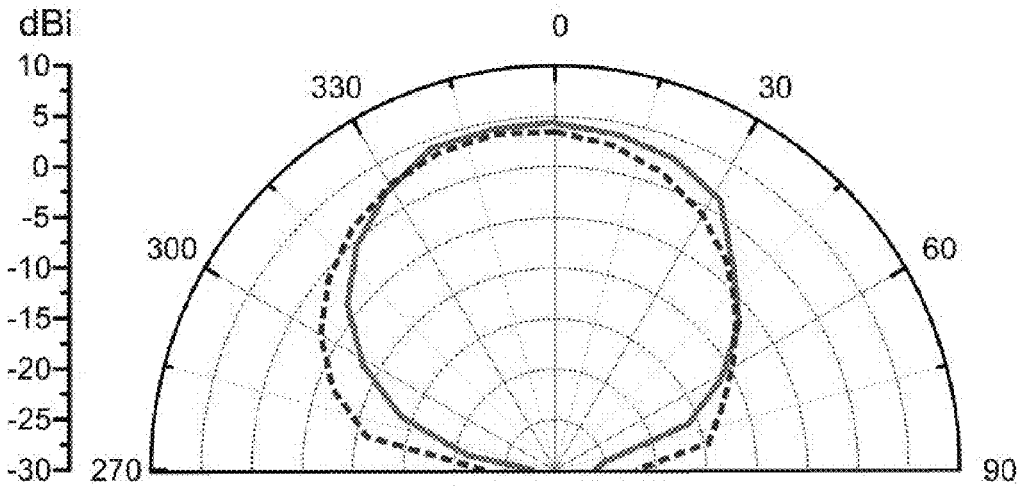
FIG. 6*a* is a graph depicting a radiation gain of the micro strip antenna on an x-z plane.
Figure 6B:
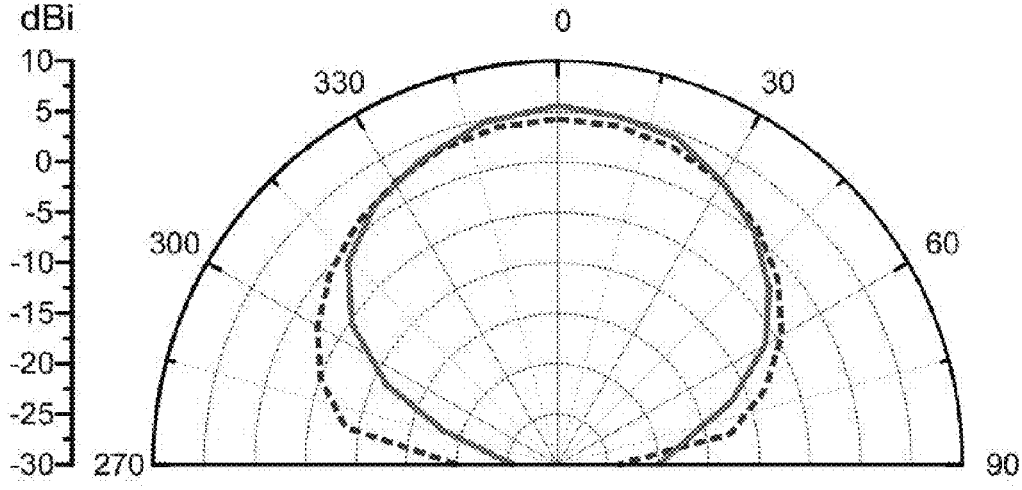
FIG. 6*b* is a graph depicting a radiation gain of the micro strip antenna on a y-z plane.

FIGS. 6*a* and 6*b* describe a radiation pattern of the micro strip antenna on both an x-z plane and a y-z plane. Herein, a broken line is a simulation value and an unbroken line is a measurement. As shown in FIGS. 6*a* and 6*b*, in the simulation value and the measurement of the micro strip antenna, there is a radiation gain of about 6 dBi in front, i.e., in a direction of 0°.

Figure 7:
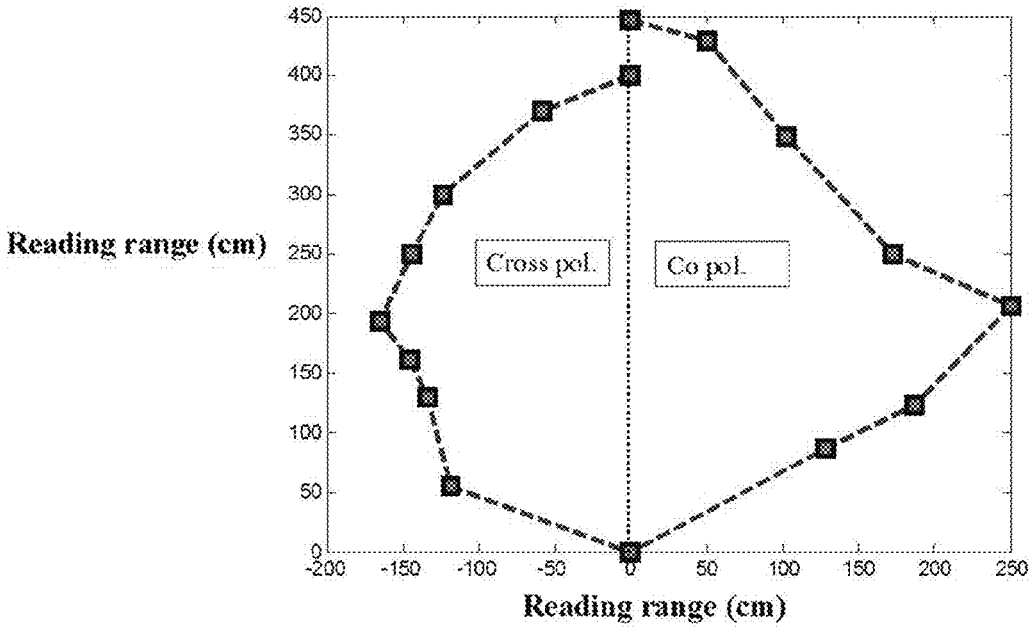
FIG. 7 is a map depicting a reading range of the micro strip antenna in both horizontal and vertical directions.

FIG. 7 is a map depicting a reading range of the micro strip antenna in both horizontal and vertical directions. Referring to FIG. 7, the micro strip antenna has similar reading ranges in both horizontal and vertical directions.

Figure 8A:
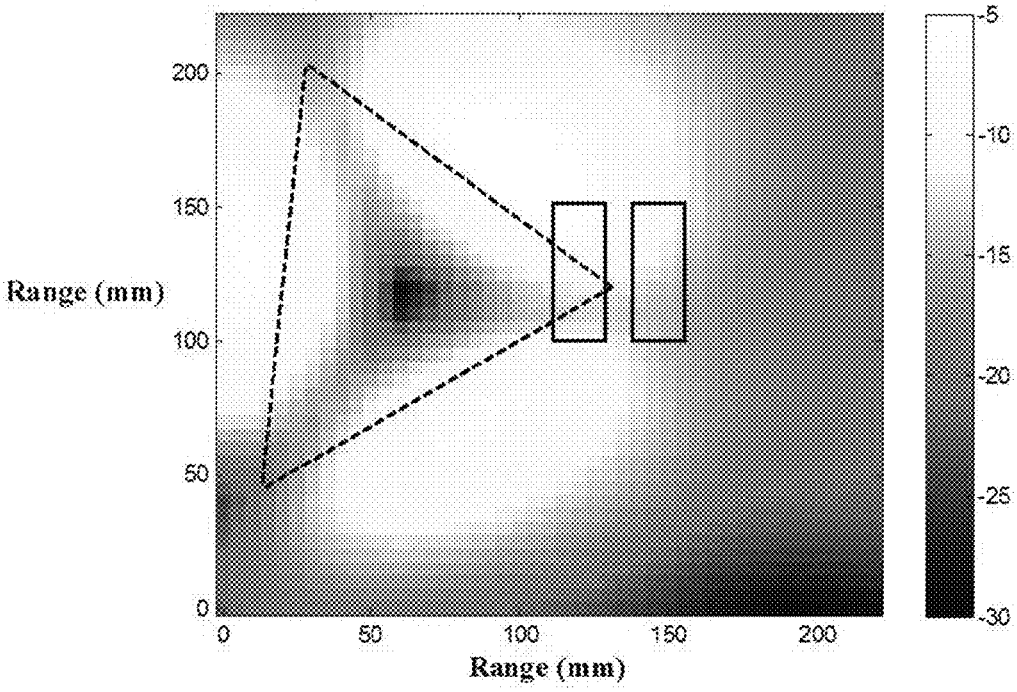
FIGS. 8*a* and 8*b* are EM simulation results and measurements describing a magnetic field of the micro strip antenna at a near-field region.
Figure 8B:
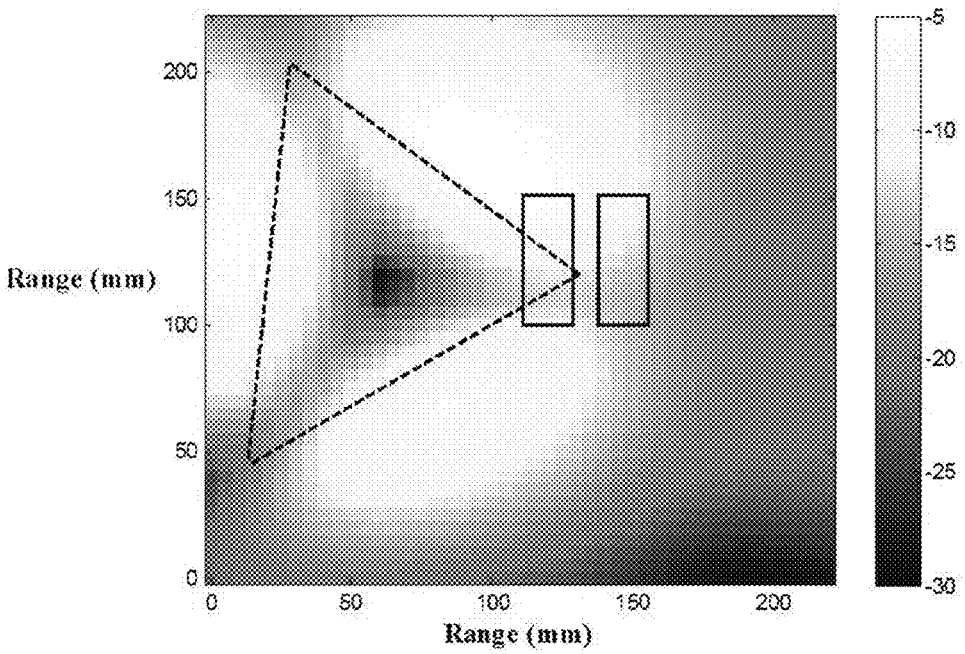

FIGS. 8*a* and 8*b* are EM simulation results and measurements describing a magnetic field of the micro strip antenna at a near-field region. FIG. 8*a* describes a simulation value, and FIG. 8*b* shows a measurement.

Referring to FIGS. 8*a* and 8*b*, the simulation value and the measurement about a magnetic field of the micro strip antenna at a near-field region are similar.

Figure 9:
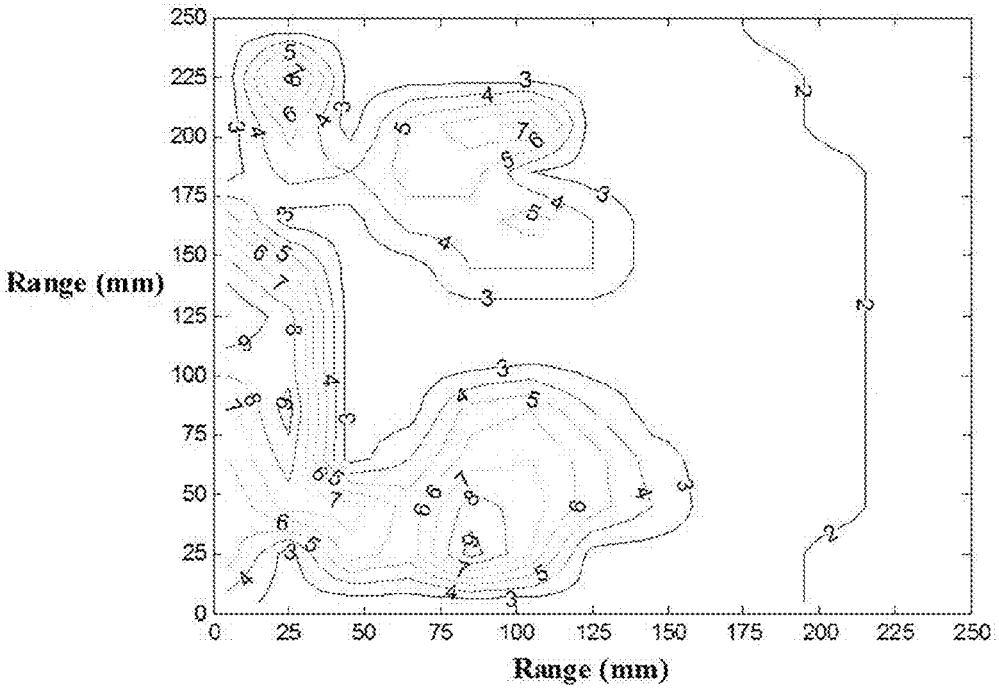
FIG. 9 is a map showing an interrogation range between the micro strip antenna and a tag used for a near-field region.

FIG. 9 is a map showing an interrogation range between the micro strip antenna and a tag used for a near-field region.

In the experiment, a container is filled up with a liquid having a high dielectric constant. A tag used for a near-field region is attached to a bottom of the container. After an aperture of the antenna is split into 13×13 sections, an interrogation range is measured at each section.

As a result, a maximum interrogation range of the micro strip antenna is about 10 cm, and an average interrogation range of the micro strip antenna is over 4.5 cm so that the micro strip antenna can operate to stably read a tag in an overall aperture.

Figure 10:
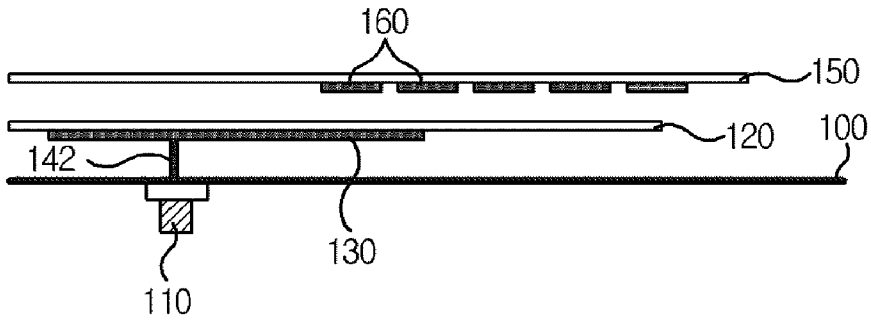
FIG. 10 is a cross-sectional view describing a micro strip antenna according to another embodiment of the present invention.

FIG. 10 is a cross-sectional view describing a micro strip antenna according to another embodiment of the present invention. Referring to FIG. 10, the micro strip antenna according to another embodiment, the sub patch 160 comprises at least two sub patch units.

Figure 11:
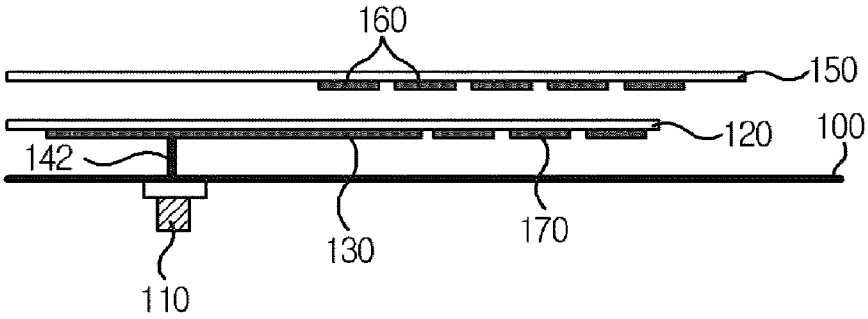
FIG. 11 is a cross-sectional view describing a micro strip antenna according to another embodiment of the present invention.

FIG. 11 is a cross-sectional view describing a micro strip antenna according to another embodiment of the present invention. Referring to FIG. 11, the micro strip antenna according to another embodiment comprises a plurality of ground patterns 170 provided at predetermined portions under the first dielectric substrate 120, wherein the predetermined portions are vertically corresponding to areas of the second dielectric substrate 150 among the sub patch units 160.

Figure 12:
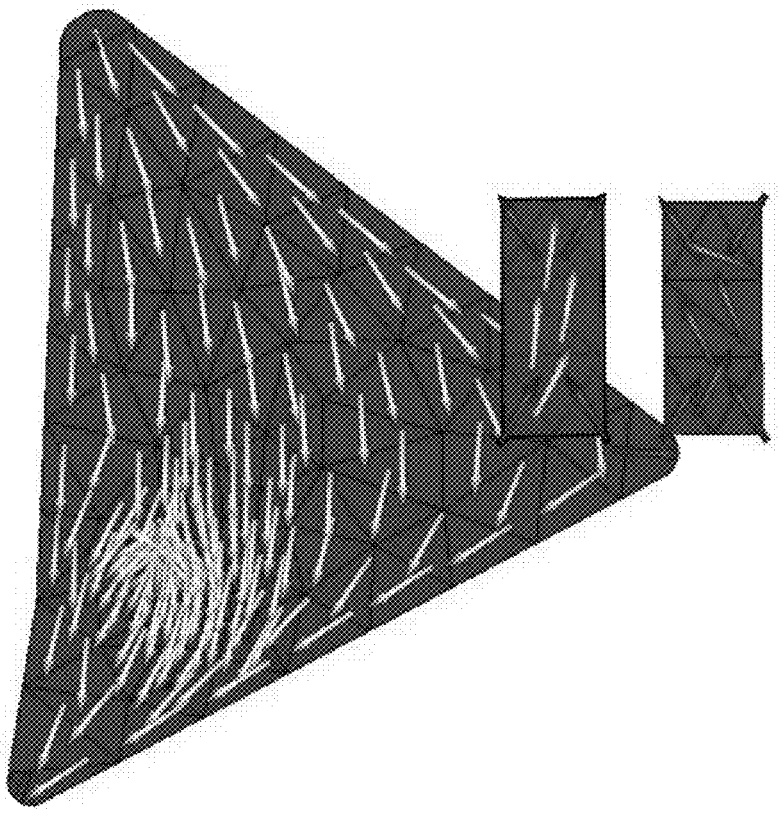
FIG. 12 describes a triangle-shaped main patch comprising three rounded corners.

Further, according to an embodiment of the present invention, a slot can be provided in an inner side of the triangle-shaped main patch 130. Also, according to another embodiment, the triangle-shaped main patch 130 can comprise three rounded corners, not angular corners, as illustrated in FIG. 12.

Meanwhile, the plurality of sub patch units 160 and the plurality of ground patterns 170 are formed in a shape of rectangular, but a micro strip antenna according to another embodiment of the present invention comprises the ground pattern having a shape of polygons and arcs.

A micro strip antenna according to an embodiment of the present invention comprises a main patch in a shape of triangle and a plurality of sub patches. Herein, the main patch has characteristics of circular polarization in a certain frequency bandwidth so as to generate a strong radiation gain, and the plurality of sub patches generates a strong and uniform vertical magnetic field at a certain level from a surface of the micro strip antenna.

Thus, the micro strip antenna can have a strong and uniform vertical magnetic field at a near-field region as well as provide uniform gain and characteristics of circular polarization at a remote-field region.

It will be apparent to those skilled in the art that various modifications and variation can be made in the present invention without departing from the spirit or scope of the invention. Thus, it is intended that the present invention cover the modifications and variations of this invention, provided they come within the scope of the appended claims and their equivalents.

What is claimed is:

1. A micro strip antenna, comprising:

a first dielectric substrate;

a main patch provided under the first dielectric substrate, the main patch having a triangle shape and configured to feed a radiation current;

a second dielectric substrate provided over the first dielectric substrate;

a sub patch provided under the second dielectric substrate and configured to receive the radiation current from the main patch in order to provide a vertical magnetic field, the sub patch comprising a plurality of sub patch units arranged in parallel; and a plurality of ground patterns provided at predetermined portions of the first dielectric substrate, the predetermined portions corresponding to areas of the second dielectric substrate among the sub patch units.

2. The micro strip antenna according to claim 1, further comprising:

a ground plane provided under the first dielectric substrate;

a coupling block provided under the ground plane and configured to feed a communication signal; and a feeding wire configured to electronically couple the coupling block to a feeding unit of the main patch.

3. The micro strip antenna according to claim 1, wherein each of the plurality of sub patch units has a shape comprising polygons and arcs.

4. The micro strip antenna according to claim 1, wherein each of the plurality of ground patterns has a shape comprising polygons and arcs.

5. The micro strip antenna according to claim 1, wherein the main patch comprises three rounded corners.

6. The micro strip antenna according to claim 1, wherein:

the main patch includes a micro strip under the first dielectric substrate; and the sub patch includes a micro strip under the second dielectric substrate.

* * * * *